US005453726A

United States Patent [19]

Montgomery

[11] Patent Number: 5,453,726

[45] Date of Patent: Sep. 26, 1995

[54] HIGH RELIABILITY THICK FILM SURFACE MOUNT FUSE ASSEMBLY

[75] Inventor: Jeffrey D. Montgomery, Vista, Calif.

[73] Assignee: AEM (Holdings), Inc., San Diego, Calif.

[21] Appl. No.: 174,865

[22] Filed: Dec. 29, 1993

[51] Int. Cl.[6] ..... H01H 85/04

[52] U.S. Cl. ..... 337/290; 337/297; 29/623

[58] Field of Search ..... 337/290, 297; 29/621, 623

[56] References Cited

U.S. PATENT DOCUMENTS 4,873,506 10/1989 Gurevich ..... 337/290

5,296,833 3/1994 Breen et al. ..... 337/297

*Primary Examiner*—Lincoln Donovan

[57] ABSTRACT

A thick film surface mountable fuse assembly for high reliability applications. In the first embodiment the fuse assembly consists of an insulative substrate on which a single low mass thick film fusible elements is disposed. The substrate utilized is a thermally and electrically insulative ceramic. Thick film contact pads permit the attachment of end-caps which are in electrical contact with the fusible element. The fusible element is covered with a coating of low temperature melting arc suppressant glass. The arc suppressant glass is substantially devoid of air thus reducing the risk of a catastrophic failure of the fuse. In a second embodiment of the fuse assembly, the thermally insulated substrate and thick film components are housed in a insert molded housing. In a third embodiment of the fuse assembly, solder bumps are deposited on the thick film contact pads, forming a flip chip package.

17 Claims, 4 Drawing Sheets

HIGH RELIABILITY THICK FILM SURFACE MOUNT FUSE ASSEMBLY

BACKGROUND AND SUMMARY OF THE INVENTION

This invention relates to a thick film fuse assembly for high reliability applications. These fuses are particularly suitable for use in circuits requiring fuses with a small footprint which are surface mountable. Further, these fuses can be provided in surface mount chip or flip chip packages and are capable of operating at voltage levels above 32 volts D.C. and at amperage ratings greater than 2.0 amps (currently the upper voltage and current limit for commercially available thin film chip fuses). The unique construction of this fuse enables it to provide much higher interrupt rating capacity than commercially available chip fuses of similar size. Additionally, these fuses are suitable for use in environments which may subject the fuse to relatively high levels of mechanical shock and vibration and a broad range of operating temperature. Because the fuse package does not outgas while in a high vacuum, this fuse is ideally suited for space and satellite applications.

Thick film high reliability fuses have, in the past, been constructed on glass or alumina (coated with dielectric barrier) substrates. Fuses manufactured on glass substrates have the following limitations:

a) only low temperature fired thick film materials may be utilized (thick film pastes which fire at temperatures over 500° C. will damage substrate).

b) low temperature thick film inks which must be utilized are less stable at higher fuse operating temperatures (above +125° C.).

c) glass substrate is susceptible to fractures during fuse processing and during normal operation when the fuse is subjected to temperature cycling.

Thick film fuses manufactured on alumina (90–99%) substrates are often costly due to the additional processing steps required to make the alumina substrate thermally insulative. This process is accomplished by coating the alumina substrate with a dielectric glass. The manufacturing process of applying the dielectric barrier to the alumina substrate involves the screen printing of a thick film dielectric glass over the surface of the alumina substrate. Several print, dry, and fire cycles are required to build up a sufficient thickness of dielectric glass to provide a thermal insulator for the thick film fuse components which are printed over the dielectric in later manufacturing steps. In the preferred embodiment of a fuse in accordance with the present invention the substrate material utilized is a thermally insulative ceramic, thus eliminating the need to add a thermal barrier to the substrate.

The primary reasons for the voltage and amperage limitations of traditional chip style fuses are as follows:

a) the fusible element is generally a thin film material which limits the amount of metallization which can be applied to the fuse element (maximum current rating is only a few amperes).

b) an adequate means of arc suppression is not provided.

c) substrate materials utilized (typically glass) are subject to fractures which may result in the premature failure of the fuse.

In the preferred embodiment of a fuse in accordance with the present invention the fuse assembly consists of an insulative substrate in which a low mass thick film element is directly disposed on the substrate. Thick film contact pads electrically connect to the fuse element to permit the attachment of end-caps. A layer of low mass thick film arc suppressive glass covers the fuse element. This construction allows for a higher amperage and voltage rating due to the ability of the arc suppressive glass to prevent restrikes and arcing during an overload current condition. Additionally, the thick film process provides the means for depositing a metallized fuse layer of sufficient thickness to allow for current ratings exceeding 10 amps. Further, copper alloy end-caps allow for greater amperage capacity while isolating the fuse assembly from potential mechanical stresses once the fuse is soldered to a printed circuit board.

BRIEF DESCRIPTION OF THE DRAWINGS

For a better understanding of the invention, reference is made to the following drawings which are to be taken in conjunction with the detailed specification to follow:

FIG. 2*a* is a sectional view of the fuse assembly; FIG. 2*b* is a top view of the fuse assembly; FIG. 2*c* is an end view of the fuse assembly;

FIG. 3*a* is a sectional view of the fuse assembly; FIG. 3*b* is an end view of the fuse assembly; FIG. 3*c* is a side view of the fuse assembly; FIG. 4*a* is a sectional view of the fuse assembly; FIG. 4*b* is a bottom view of the fuse assembly; FIG. 4*c* is an end view of the fuse assembly.

DETAILED DESCRIPTION OF THE PREFERRED EMBODIMENTS

Figure 1A:
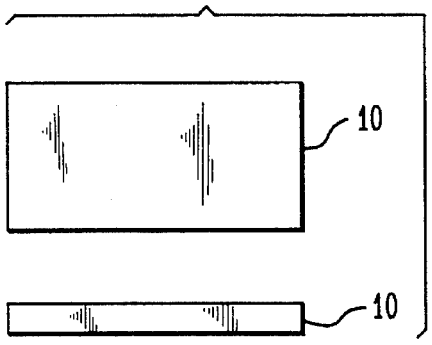
FIGS. 1*a* through 1*d* illustrate the construction for a thick film fuse assembly constructed in accordance with the invention.
Figure 1B:
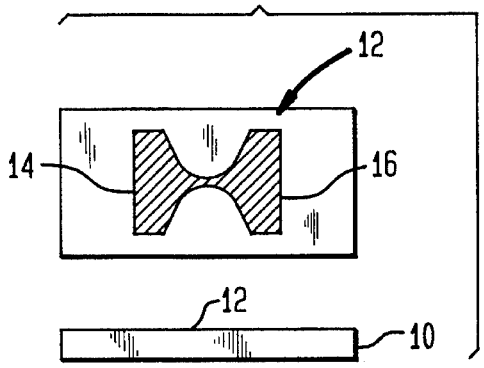
Figure 1C:
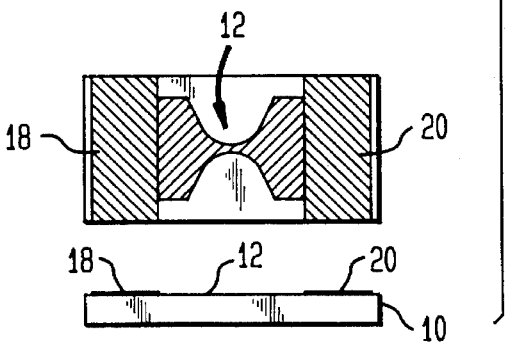
Figure 1D:
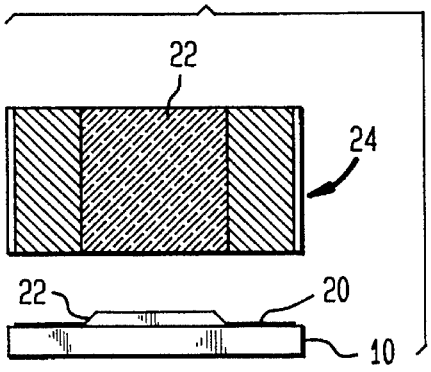

FIGS. 1*a*–1*d* illustrate the construction for a thick film fuse assembly in accordance with the invention. The assembly begins with a substrate 10 for supporting the other elements of the assembly. Substrate 10 should be thermally and electrically insulative. Substrate 10 must also be capable of withstanding the temperatures (850° C.) required for "firing" the thick film elements without warping or deforming. Additionally, substrate 10 must be able to withstand several thousand temperature cycles of −65° C. to +125° C. as may occur during the life of the fuse. In the case at hand, substrate 10 is calcium boro-silicate ceramic, which is thermally and electrically insulative and capable of withstanding high temperature processing. Additional substrate materials which have proven useful are those constructed from zirconium oxide and alumina substrates which are formulated with a relatively high percentage (30%) of glass.

After completion of the substrate 10, the thick film fuse element 12 is disposed on substrate 10. Thick film fuse element 12 is comprised of a suitable conductive metal (such as a fritless gold) which is screen printed and fired directly onto substrate 10. As substrate 10 is selected so as to have the proper thermal and electrical insulating properties substrate 10 can remain uncoated. The preferred material for the element 12 is a thick film gold which will readily migrate into the preferred arc suppressive material when the fuse assembly is subjected to overload currents. As seen in FIG.

1*b*, fusible element 12 comprises end portions 14 and 16 and can be characterized as being "bow-tie" shaped. After screen printing of the fuse element 12, the entire assembly is fired at a suitable firing temperature, such as 850° C. The thickness and geometry of the fusible element 12 may be adjusted in accordance with the voltage, amperage, and clear-time requirements of the desired fuse. By way of example only, a fusible element 12 comprised of gold and having a thickness of approximately 40 microns provides a 7.5 amp fuse.

After printing and firing of the fuse element 12, thick film terminations 18, 20 are screen printed and fired at 850° C. onto substrate 10. Thick film terminations 18, 20 are comprised of any suitable conductive metal, such as silver, and overlay a portion of the fuse element 12 so as to provide a connection between fuse element 12 and end-caps or external leads. After the placement and firing of terminations 18, 20 on substrate 10, a thick film of low melting point arc suppressant glass is screen printed or syringe dispensed and fired at 450° C. Arc suppressant glass 22 covers all portions of the fusible element 12 and extends slightly onto terminations 18, 20. Compared to the thickness of the terminations 18, 20 and fusible element 12, arc suppressant glass 22 has a much greater thickness (approximately 0.030 inches). This is to provide a sufficient mass of glass to absorb the material of fuse element 12 as the fuse clears (blows). Arc suppressant glass 22 is fired at a lower temperature than that of the other elements since it has a lower melting point in accordance with the need to melt before the clearing of fuse element 12. After firing, arc suppressant glass 22 is substantially devoid of air. A suitable glass for the arc suppressant glass 22 is lead boro-silicate glass with a thermal expansion coefficient matched to that of the substrate utilized. The glass used should have a melting temperature of 425° C. to 500° C. Glasses with high melting temperatures are not suitable for this application and if utilized will result in a fuse assembly with very slow and undesirable clearing characteristics. As will be discussed in detail below, the completed fuse assembly 24 will have end-caps, leads, or solder bumps disposed on the thick film contact pads.

Figure 2A:
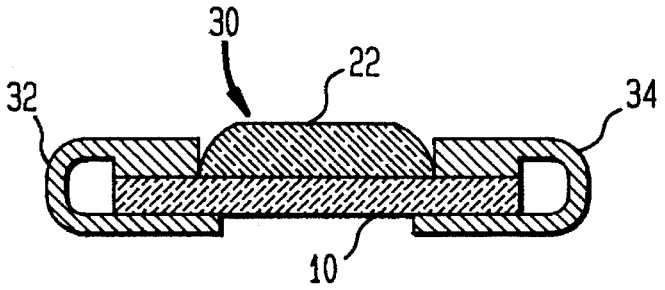
FIGS. 2*a* through 2*c* illustrate the fuse assembly as configured in a surface mountable chip package.
Figure 2B:
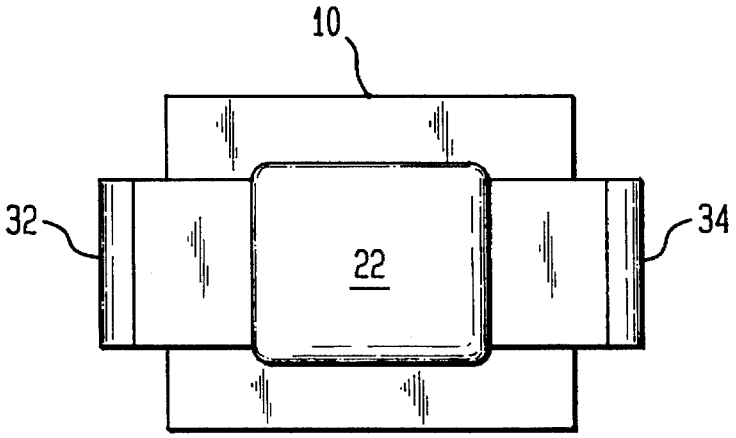
Figure 2C:
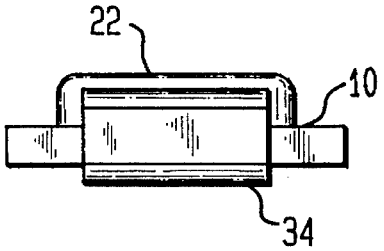

The fuse assembly 24, may be mounted in a large variety of surface mount configurations for attachment to the circuit in which the fuse will operate. FIG. 2 illustrates a chip style package 30 for disposing a completed assembly 24. In this construction, external end-caps 32, 34 are soldered to thick film terminations 18, 20 on substrate 10. A suitable material for end-caps 32, 34 is copper or a copper alloy. As end-caps 32, 34 are soldered or brazed to only one side of the substrate 10, this package can be soldered directly onto the appropriate printed circuit board with reduced probability of substrate failure when temperature coefficient of expansion differences exist between the circuit board and the fuse substrate.

Figure 3A:
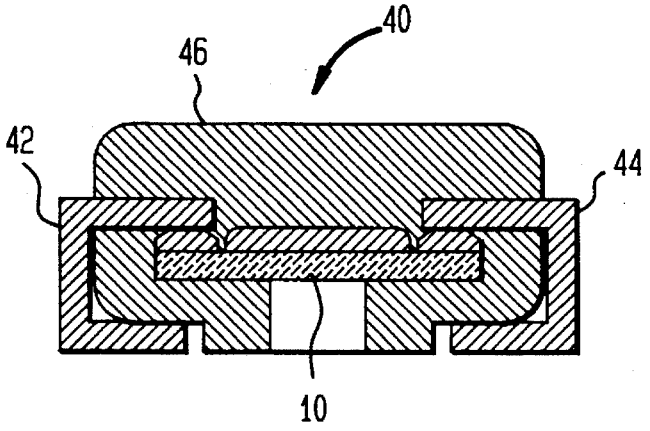
FIGS. 3*a* through 3*c* illustrate the fuse assembly in a surface mountable high temperature plastic housing.
Figure 3B:
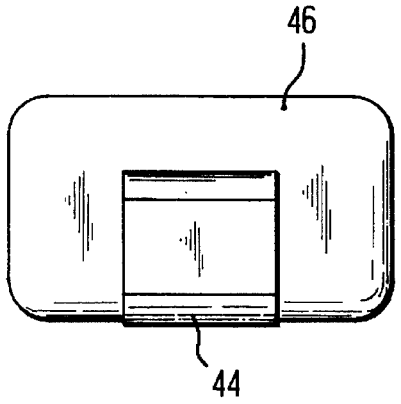
Figure 3C:
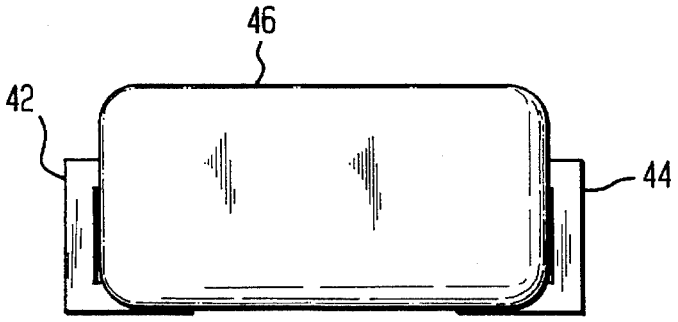

FIG. 3 illustrates a housed surface mountable package 40 for the fuse assembly in accordance with the invention. In this construction "J" type leads, 42, 44 are soldered or brazed to thick film terminations 18, 20 and the entire package is surrounded by a high temperature plastic molded body 46. A suitable high temperature plastic for the molded body 46 is Polyphenylene Sulfide (PPS). As the "J" leads 42, 44 extend underneath the body 46, package 40 may be soldered or bonded directly to an appropriate printed circuit board.

Figure 4A:
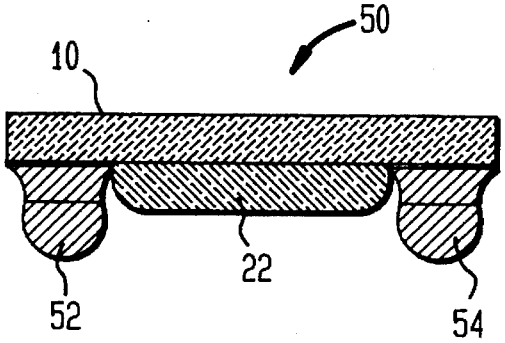
FIGS. 4*a* through 4*c* illustrate the fuse assembly as configured in a surface mountable flip chip package.
Figure 4B:
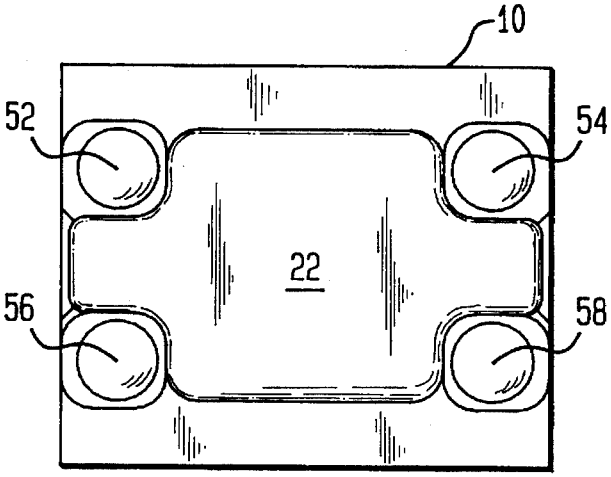
Figure 4C:
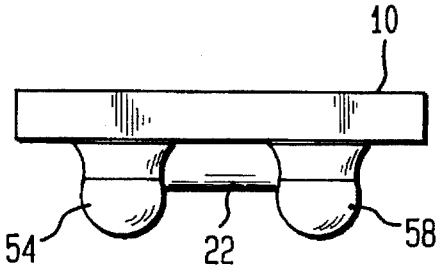

FIG. 4 illustrates a surface mountable flip chip package 50 for the fuse assembly in accordance with the invention. In this construction, solder bumps 52, 54, 56, 58 are dispensed and reflowed onto the thick film terminations 18, 20 on substrate 10. The height of the solder bumps 52, 54, 56, 58 is on the order of 0.035 to 0.045 inches. A suitable material for the solder bumps 52, 54, 56, 58 is a high temperature solder with a composition of 10 percent tin, 88 percent lead, and 2 percent silver. As the high temperature solder bumps 52, 54, 56, 58 will not reflow at temperatures below 290° C., these fuses may be soldered onto circuit boards using typical 215° C. (vapor phase) or 250° C. (infrared) soldering profiles (60/40 or 63/37 solder paste applied to circuit board) while the bumps will not reflow thus keeping the fuse assembly 50 elevated from the circuit board. Additionally, the high lead content of the solder bumps 52, 54, 56, 58 makes the bumps more compliant (and therefore more fatigue resistant) than solder bumps with a lesser lead content. The silver content of the solder bumps 52, 54, 56, 58 helps prevent the leaching of the thick film silver termination pads 18, 20. Arc suppressant glass 22 can be applied as a barrier between solder bumps 52, 56 on thick film termination pad 18 and solder bumps 54, 58 on thick film termination pad 20.

The above-described are merely illustrative of the principals and construction of the present invention. Numerous modifications and adaptations thereof will be readily apparent to those skilled in the art without departing from the spirit and scope of the present invention.

What is claimed is:

1. A surface mount fuse assembly comprising:

a thermally and electrically insulative ceramic substrate;

a fusible thick film conductive element directly disposed on said substrate, said fusible element having first and second end portions thereof and further characterized as being "bow-tie" shaped;

thick film contact pads disposed on said substrate, said contact pads respectively overlying portions of and being in electrical contact with first and second end portions of said fusible element; and a layer of low melting point arc suppressant material covering all portions of said fusible element and extending onto said thick film contact pads, said arc suppressant material being substantially devoid of air and further having a thermal expansion coefficient matched to that of said substrate, said fusible element further comprising a material for readily migrating into said arc suppressant material upon said fusible element being subjected to an overload current, wherein further said arc suppressant material is of a sufficient mass to absorb the material of said fusible element upon said fusible element being subjected to the overload current.

2. The fuse assembly as claimed in claim 1 wherein said insulative substrate is a calcium boro-silicate ceramic.

3. The fuse assembly as claimed in claim 1 wherein said insulative substrate is a zirconium oxide ceramic.

4. The fuse assembly as claimed in claim 1 wherein said insulative substrate is a ceramic formed from alumina mixed with a high content of glass.

5. The fuse assembly as claimed in claim 1 wherein said insulative substrate is alumina coated with a dielectric thermal barrier.

6. The fuse assembly as claimed in claim 1 wherein said element is comprised of a thick film gold.

7. The fuse assembly as claimed in claim 1 wherein said low melting point material is glass.

8. The fuse assembly as claimed in claim 1 wherein said thick film contact pads are silver.

9. A method for manufacturing a surface mount fuse comprising the steps of:

providing a thermally and electrically insulative ceramic substrate;

disposing a thick film fusible gold element directly on the surface of said substrate, said thick film fusible bold element having first and second end portions thereof and further characterized as being "bow-tie" shaped;

disposing first and second thick film contact pads on said substrate at respective first and second ends of said fusible element and in electrical contact therewith; and coating said fusible element with a low melting point arc suppressant material, said arc suppressant material covering all portions of said fusible element and extending onto said thick film contact pads, said arc suppressant material being substantially devoid of air and further having a thermal expansion coefficient matched to that of said substrate, said fusible element further comprising a material for readily migrating into said arc suppressant material upon said fusible element being subjected to an overload current, wherein further said arc suppressant material is of a sufficient mass to absorb the material of said fusible element upon said fusible element being subjected to the overload current.

10. The method as claimed in claim 9 further including the step of attaching end-caps to said contact pads.

11. The method as claimed in claim 9 further including the step of molding a housing about said fuse assembly.

12. The method as claimed in claim 9 wherein arc suppressive material forms a smooth and relatively flat surface compatible with conventional pick and place circuit board assembly equipment.

13. The method as claimed in claim 10 wherein said end-caps are a copper alloy and are attached to the fuse assembly with a high temperature solder.

14. The method as claimed in claim 11 wherein said molded housing is a high temperature thermoset or thermoplastic with low outgassing characteristics.

15. The method as claimed in claim 9 further including the step of depositing solder bumps on said contact pads.

16. The method as claimed in claim 15 wherein said solder bumps are formed from a high temperature solder or brazing compound.

17. The method as claimed in claim 15 wherein said solder bumps are disposed at the corners of said fuse assembly.

* * * * *